US010378184B2

(12) United States Patent
Vigholm

(10) Patent No.: US 10,378,184 B2
(45) Date of Patent: Aug. 13, 2019

(54) LOAD SENSING HYDRAULIC SYSTEM FOR A WORKING MACHINE

(71) Applicant: VOLVO CONSTRUCTION EQUIPMENT AB, Eskilstuna (SE)

(72) Inventor: Bo Vigholm, Stora Sundby (SE)

(73) Assignee: Volvo Construction Equipment AB, Eskilstuna (SE)

( * ) Notice: Subject to any disclaimer, the term of this patent is extended or adjusted under 35 U.S.C. 154(b) by 0 days.

(21) Appl. No.: 15/577,855

(22) PCT Filed: Jun. 16, 2015

(86) PCT No.: PCT/SE2015/050710
§ 371 (c)(1),
(2) Date: Nov. 29, 2017

(87) PCT Pub. No.: WO2016/204663
PCT Pub. Date: Dec. 22, 2016

(65) Prior Publication Data
US 2018/0171591 A1 Jun. 21, 2018

(51) Int. Cl.
*E02F 9/22* (2006.01)
*F15B 11/16* (2006.01)

(52) U.S. Cl.
CPC ..... *E02F 9/2203* (2013.01); *E02F 9/2232* (2013.01); *E02F 9/2292* (2013.01); (Continued)

(58) Field of Classification Search
CPC ..... E02F 9/2203; E02F 9/2232; E02F 9/2292; E02F 9/2296; F15B 11/165
See application file for complete search history.

(56) References Cited

U.S. PATENT DOCUMENTS 5,085,051 A 2/1992 Hirata
5,236,230 A 8/1993 Mudge, Jr. et al.
(Continued)

FOREIGN PATENT DOCUMENTS

JP H10267004 A 10/1998

OTHER PUBLICATIONS

International Search Report (dated Mar. 3, 2016) for corresponding International App. PCT/SE2015/050710.

*Primary Examiner* — Anne M Antonucci
*Assistant Examiner* — Renee LaRose
(74) *Attorney, Agent, or Firm* — WRB-IP LLP

(57) ABSTRACT

A hydraulic system for a working machine is a load sensing (LS) system and includes a first hydraulic actuator and a first control valve for controlling the flow of hydraulic fluid from a pump to the first hydraulic actuator and for draining hydraulic fluid from the first hydraulic actuator, respectively, and a second hydraulic actuator and a second control valve for controlling the flow of hydraulic fluid from the pump to the second hydraulic actuator and for draining hydraulic fluid from the second hydraulic actuator, respectively. The hydraulic system further includes a first hydraulic circuit for providing an LS pressure for the first actuator and a second hydraulic circuit for providing an LS pressure for the second actuator. At least one of the first and second hydraulic circuits includes an offset valve for changing the LS pressure before providing the LS pressure to the pump.

8 Claims, 4 Drawing Sheets

(52) U.S. Cl.
CPC ..... *E02F 9/2296* (2013.01); *F15B 11/165* (2013.01); *F15B 2211/20546* (2013.01); *F15B 2211/253* (2013.01); *F15B 2211/6057* (2013.01); *F15B 2211/653* (2013.01); *F15B 2211/654* (2013.01); *F15B 2211/71* (2013.01)

(56) References Cited

U.S. PATENT DOCUMENTS

| | | | | |
|---|---|---|---|---|
| 2007/0283688 | A1 | 12/2007 | Vigholm et al. | |
| 2009/0071144 | A1 | 3/2009 | Ma et al. | |
| 2010/0242464 | A1 | 9/2010 | Vigholm et al. | |
| 2013/0055705 | A1 | 3/2013 | Mori et al. | |
| 2013/0098015 | A1 * | 4/2013 | Opdenbosch ..... | E02F 9/2289 60/327 |
| 2013/0280097 | A1 | 10/2013 | Narotham | |

* cited by examiner

LOAD SENSING HYDRAULIC SYSTEM FOR A WORKING MACHINE

BACKGROUND AND SUMMARY

The invention relates to a hydraulic system for a working machine. The hydraulic system is a load sensing (LS) system and comprises a first hydraulic actuator and a first control valve for controlling the flow of hydraulic fluid from a pump to the first hydraulic actuator and for draining hydraulic fluid from the first hydraulic actuator, respectively, and a second hydraulic actuator and a second control valve for controlling the flow of hydraulic fluid from the pump to the second hydraulic actuator and for draining hydraulic fluid from the second hydraulic actuator, respectively. The hydraulic system further comprises a first circuit for providing an LS pressure for the first actuator and a second circuit for providing an LS pressure for the second actuator.

The invention can be applied on different types of hydraulic system, for example hydraulic systems for operating hydraulic cylinders for lifting an arm or tilting an implement of a wheel loader or for operating hydraulic cylinders for a dump body of an articulated hauler and/or for steering of a working machine.

Although the invention will be described with respect to a hydraulic system for a wheel loader, the application of the invention is not restricted to this particular application, but may also be used in other hydraulic systems and vehicles.

A working machine is usually provided with a bucket, container or other type of implement for digging, lifting, carrying and/or transporting a load.

For example, a wheel loader has a lift arm unit for raising and lowering an implement, such as a bucket. The lift arm unit comprises hydraulic cylinders for movement of a load arm and the implement attached to the load arm, Usually a pair of hydraulic cylinders is arranged for raising the load arm and a further hydraulic cylinder is arranged for tilting the implement relative to the load arm.

In addition, the working machine is often articulated frame-steered and has a pair of hydraulic cylinders for turning steering the working machine by pivoting a front section and a rear section of the working machine relative to each other.

The hydraulic system generally further comprises at least one hydraulic pump, which is arranged to supply hydraulic power, i.e. hydraulic flow and hydraulic pressure, to the hydraulic cylinders. The hydraulic pump is driven by a power source, such as an internal combustion engine or an electric motor. The hydraulic system of a working machine is usually a so called load sensing system (LS-system). This means that the pump that provides the actuators with hydraulic fluid receives a signal representing the current load pressure of a hydraulic cylinder in operation. The pump is then controlled to provide a pressure which is somewhat higher than the load pressure of the hydraulic cylinder.

The hydraulic pump is often a variable displacement pump that is driven by the prime mover of the working machine. If the pump is driven by an internal combustion engine, the pump is connected to a power take-off which can be located between the internal combustion engine and a transmission arrangement, such as a gear box. The transmission arrangement is in turn connected to e.g. wheels of the working machine for the propulsion thereof.

When driving a hydraulic cylinder in an LS-system, hydraulic oil is supplied by the pump and the flow of hydraulic oil from the pump is directed by an inlet valve to one side of the hydraulic cylinder and the flow of hydraulic oil from the other side of the hydraulic cylinder is drained to tank by an outlet valve.

The pump pressure is the LS pressure (representing the actual load pressure of the actuator) plus a margin pressure. When the pump is used for several functions the pump is controlled by the highest LS pressure and a certain margin pressure. A disadvantage with such a system is however that the pump is always supplying hydraulic oil with the same margin pressure. For example, different functions may require different margin pressures. In a case where the LS pressure of a function that requires a lower margin pressure determines the pump pressure, the losses will be unnecessarily high since the pressure drop over the control valve will correspond to the margin pressure.

It is desirable to provide a hydraulic system, by which system the energy losses and thereby the fuel consumption can be reduced.

The invention, according to an aspect thereof, is based on the insight that by the provision of a hydraulic system where at least one of the first and second circuits comprises an offset valve for changing the LS pressure before providing the LS pressure to the pump, different margin pressures can be obtained for different functions.

For example, in a wheel loader the steering hydraulics needs a higher margin pressure than the working hydraulics (such as lift, tilt, etc.). By providing different margin pressures the working hydraulics can be driven more efficiently when an LS pressure of this function determines the pump pressure. The energy losses can be reduced due to the fact that the pressure drop over the control valve is decreased.

According to one embodiment of the invention, the hydraulic system comprises an offset valve arranged for increasing the LS pressure. Hereby, the first actuator can be driven while using a higher effective margin pressure. The pump may be controlled to provide a pump pressure based on the LS pressure and a predetermined margin pressure By increasing the LS pressure, the pump pressure will be higher and thus the effective margin pressure will be higher than the predetermined margin pressure.

According to a further embodiment of the invention, the offset valve comprises a first port for connection to the incoming LS pressure and a second port for connection to a pressure source having higher pressure than the incoming LS pressure, and a port for providing an increased LS pressure, and a spool for selecting between a first state, where the first port is closed and the second port is opened, and a second state, where the first port is opened and the second port is closed, wherein the offset valve further comprises a spring arranged to apply a force on the spool in a first direction towards the first state, and the hydraulic system has a means for applying the incoming LS pressure to the spool for creating a force in said first direction towards the first state, and a means for applying the increased LS pressure to the spool for creating a force in a second direction towards the second state. Hereby, a positive offset of the LS pressure and thereby an increased effective margin pressure can be achieved in a non-complicated and robust way.

According to one embodiment of the invention, the hydraulic system comprises an offset valve arranged for decreasing the LS pressure. Hereby, the first actuator can be driven while using a lower effective margin pressure. The pump may be controlled to provide a pump pressure based on the LS pressure and a predetermined margin pressure. By decreasing the LS pressure, the pump pressure will be lower and thus the effective margin pressure will be lower than the predetermined margin pressure.

According to a further embodiment of the invention, the offset valve comprises a first port for connection to the incoming LS pressure and a second port for connection to a pressure source having lower pressure than the incoming LS pressure, and a port for providing an decreased LS pressure, and a spool for selecting between a first state, where the first port is closed and the second port is opened, and a second state, where the first port is opened and the second port is closed, wherein the offset valve further comprises a spring arranged to apply a force on the spool in a first direction towards the first state, and the hydraulic system has a means for applying the decreased LS pressure to the spool for creating a force in the first direction towards the first state, and a means for applying the incoming LS pressure to the spool for creating a force in a second direction towards the second state. Hereby, a negative offset of the LS pressure and thereby a decreased effective margin pressure can be achieved in a non-complicated and robust way.

According to a further aspect, the invention relates to a working machine. The same advantages as discussed above with reference to the hydraulic system can be reached by the working machine according to the invention.

Further advantages and advantageous features of the invention are disclosed in the following description and in the dependent claims.

BRIEF DESCRIPTION OF THE DRAWINGS

With reference to the appended drawings, below follows amore detailed description of embodiments of the invention cited as examples.

In the drawings.

DETAILED DESCRIPTION

Figure 1:
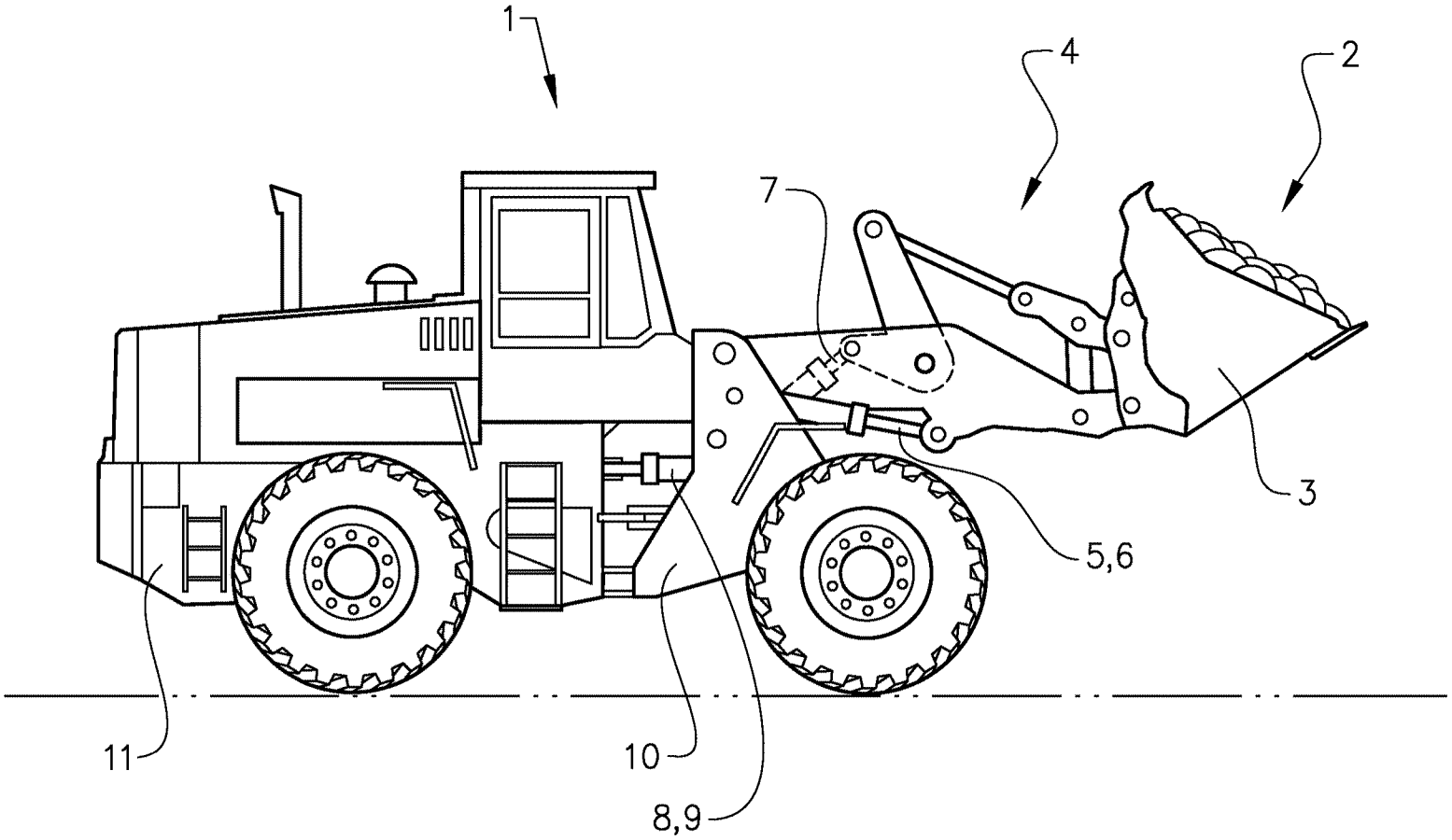
FIG. 1 is a lateral view illustrating a wheel loader having a hydraulic system according to the invention.

FIG. 1. is an illustration of a working machine I in the form of a wheel loader. The wheel loader is an example of a working machine where a hydraulic system according to the invention can be applied.

The wheel loader has an implement 2. The term "implement" is intended to comprise any kind of tool controlled by hydraulics, such as a bucket, a fork or a gripping tool. The implement illustrated is a bucket 3 which is arranged on a load arm 4 for lifting and lowering the bucket 3, and further the bucket can be tilted relative to the load arm. In the example embodiment illustrated in FIG. 1 a hydraulic system of the wheel loader comprises two hydraulic cylinders 5, 6 for the operation of the load arm 4 and one hydraulic cylinder 7 for tilting the bucket 3 relative to the load arm 4.

The hydraulic system of the wheel loader further comprises two hydraulic cylinders 8, 9, steering cylinders, arranged on opposite sides of the wheel loader 1 for turning the wheel loader by means of relative movement of a front body part 10 and a rear body part 11. In other words; the wheel loader is articulated frame-steered by means of the steering cylinders 8, 9. There is a pivot joint connecting the front body part 10 and the rear body part 11 of the wheel loader 1 such that these parts are pivotally connected to each other for pivoting about a substantially vertical axis.

Figure 2B:
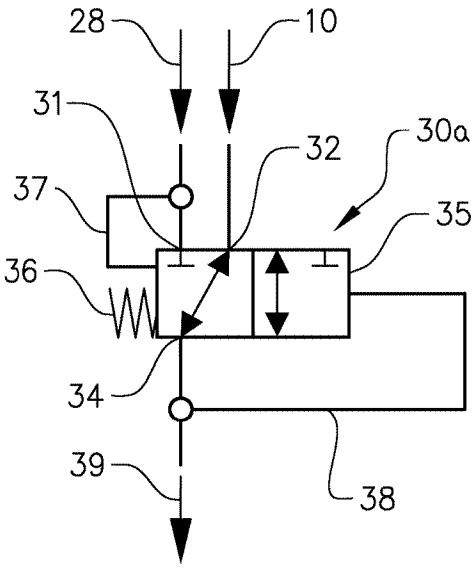
FIG. 2*b* is an enlarged view of the offset valve of the hydraulic system illustrated in FIG. 2.
Figure 2:
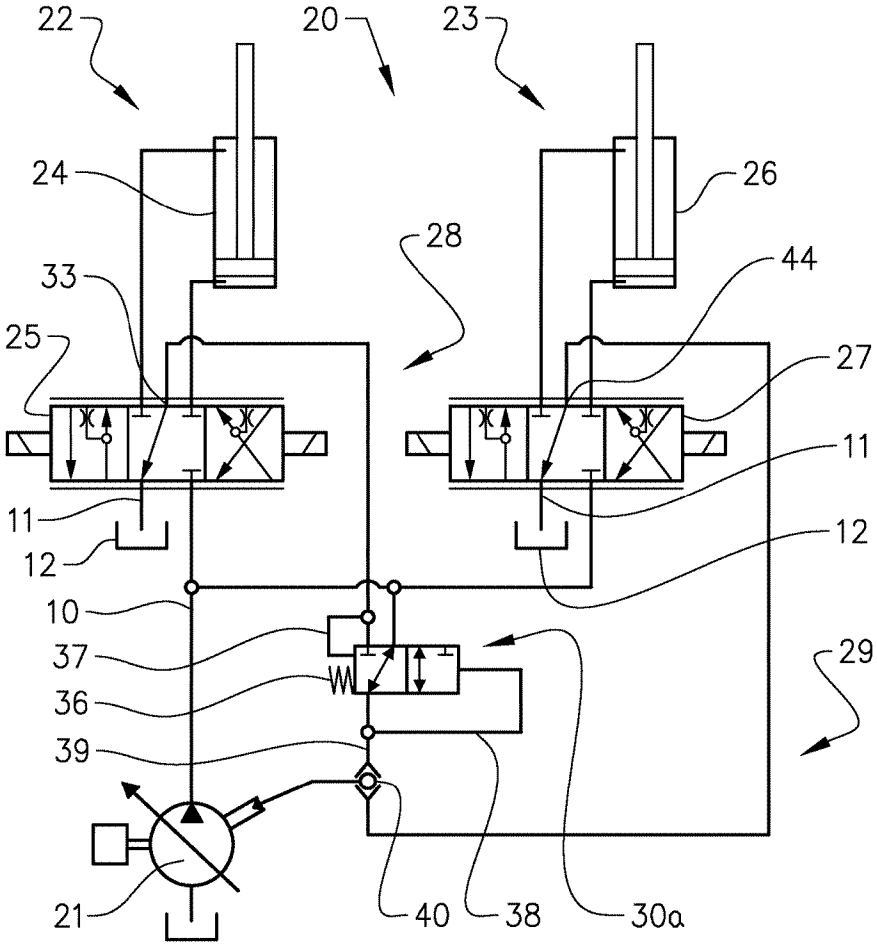
FIG. 2 shows one embodiment of the hydraulic system according to the invention.

One example embodiment of the hydraulic system according to the invention is illustrated in FIG. 2. The hydraulic system 20 is a load sensing (LS) system. A pump 21 may supply two or more functions 22, 23 with hydraulic fluid. The pump is controlled based on the highest LS-signal from a function that is active and thus has the highest load pressure. The pump will then provide the hydraulic system with a pressure that is higher than the highest load pressure, i.e. a pump pressure that is the load pressure plus a margin pressure. The pump is preferably a variable pump having a displacement that can be varied. The pump can for example be driven by an internal combustion engine or an electric motor.

By hydraulic fluid means hydraulic oil or any other corresponding fluid suitable for a hydraulic system.

The hydraulic system 20 for a working machine comprises a first hydraulic actuator 24 and a first control valve 25 for controlling the flow of hydraulic fluid from the pump 21 to the first hydraulic actuator and for draining hydraulic fluid from the first hydraulic actuator, respectively. The hydraulic system 20 further comprises a second hydraulic actuator 26 and a second control valve 27 for controlling the flow of hydraulic fluid from the pump 21 to the second hydraulic actuator and for draining hydraulic fluid from the second hydraulic actuator, respectively. This is suitably performed by means of supply conduits 10 extending from the pump 21 to the control valves 25, 27, and further to the actuators, and drain conduits 11 extending from the actuators to the control valves 25, 27 and further to tank 12.

Although in the example embodiments the first and second control valves are illustrated as separate valves, these valves could be integrated in one and the same valve assembly for controlling the flow to the respective actuator.

The hydraulic system 20 anther comprises a first hydatid circuit 28 for providing an LS pressure for the first actuator 24 and a second hydraulic circuit 29 for providing an LS pressure for the second actuator 26. The LS pressures represent the load pressures of the actuators and are used for controlling the pump pressure. Usually, the pump pressure, $P_P$, is the LS pressure, $P_{LS}$, plus a margin pressure, $P_M$, i.e. the pump pressure is $P_P=P_{LS}+P_M$.

According to the invention, at least one of the first and second hydraulic circuits 28, 29 comprises an offset valve 30*a*, 30*b* for changing the LS pressure before providing the LS pressure to the pump 21.

Thereby the effective margin pressure can be changed though the predetermined margin pressure of the pump is not changed. For example, an offset valve 30*a* can be arranged for providing a positive offset of the LS pressure, i.e. an increased LS pressure which will result in an increased effective margin pressure. The pump pressure is then $P_P=P_{LS}+\Delta P+P_M$, where the changed LS pressure provided to the pump is $P_{LS}+\Delta P$ and thus the effective margin pressure is $P_M+\Delta P$. The offset valve 30*a* arranged in the hydraulic system 20 illustrated in FIG. 2 will give an increased margin pressure.

The margin pressure is usually the stand-by pressure of the pump. Thus, the use of an offset valve for increasing the LS pressure will also increase the stand-by pressure of the pump.

Correspondingly, an offset valve 30*b* can be arranged for providing a negative offset of the LS pressure, i.e. a decreased LS pressure which will result in a decreased effective margin pressure. The pump pressure is then $P_P=P_{LS}-\Delta P+P_M$, where the changed LS pressure provided to the pump is $P_{LS}-\Delta P$ and thus the effective margin pressure is $P_M-\Delta P$. Such an embodiment is illustrated in FIG. 3.

The use of a negative offset valve for decreasing the LS pressure will usually not decrease the stand-by pressure of the pump, since the stand-by pressure is determined by the highest margin pressure of any function.

With reference to FIG. 2 the margin pressure of the pump can for example be set to 10 bar. The offset valve can be adapted to increase the LS pressure such that the effective margin pressure will be for example 23 bar. The pump 21 will then supply hydraulic fluid to the first actuator 24 with a pressure drop over the first control valve 25 of 23 bar and to the second actuator 26 with a pressure drop over the second control valve 27 of 10 bar.

In the example embodiment illustrated in FIG. 2 and FIG. 2*b*, the offset valve 30*a* comprises a first port 31 for connection to the incoming LS pressure and a second port 32 for connection to a pressure source having higher pressure than the incoming LS pressure. This pressure has to be at least the incoming LS pressure plus the desired change in LS pressure ΔP, or a higher pressure. The pressure source can be the pump 21 and in this example the pump pressure is applied to the second port 32 by means of said supply conduit 10. The incoming LS pressure can be received from an LS port 33 of the first control valve 25 by means of the first LS circuit 28.

The offset valve 30*a* further comprises a port 34 for providing an increased LS pressure, and a spool 35 for selecting between a first state, where the first port 31 is closed and the second port 32 is opened, and a second state, where the first port 31 is opened and the second port 32 is closed. Furthermore, the offset valve 30*a* comprises a spring 36 arranged to apply a force on the spool 35 in a first direction towards the first state, and the hydraulic system has a means 37 for applying the incoming LS pressure to the spool 35 for creating a force in said first direction towards the first state, and a means 38 for applying the increased LS pressure to the spool 35 for creating a force in a second direction towards the second state.

The means for applying the incoming LS pressure to the spool 35 can be a conduit 37 connecting the first LS pressure circuit 28 and the spool 35 of the valve 30*a* and the means for applying the increased LS pressure to the spool 35 of the valve 30*a* can be a conduit 38 connecting the increased LS pressure port 34 of the valve and the spool of the valve.

By selecting a spring 36 giving a certain spring force, the desired offset can be reached. The increased LS pressure 39 provided to the pump is $P_{LS}+\Delta P$, where ΔP is a function of the spring force caused by the spring 36.

The conduit portion 39 of the first LS circuit 28 for providing the changed LS pressure for the first actuator 24 and the second LS circuit 29 for providing the LS pressure for the second actuator 26 are suitably connected to a shuttle valve 40, which in turn connected to a control equipment of the pump 21. Thereby the highest LS pressure provided by the functions is provided for controlling the pump.

Figure 3B:
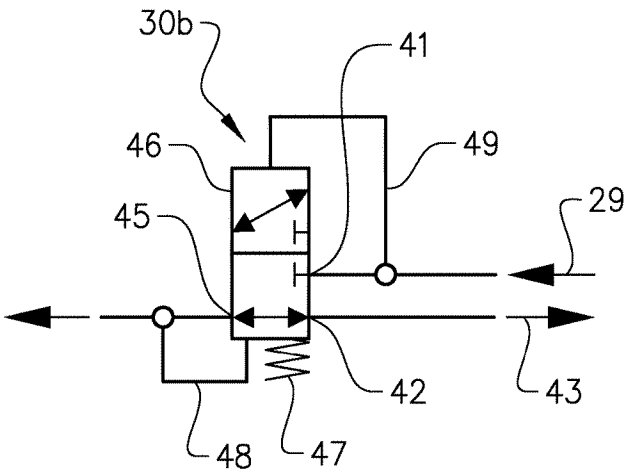
FIG. 3*b* is an enlarged view of the offset valve of the hydraulic system illustrated in FIG. 3.
Figure 3:
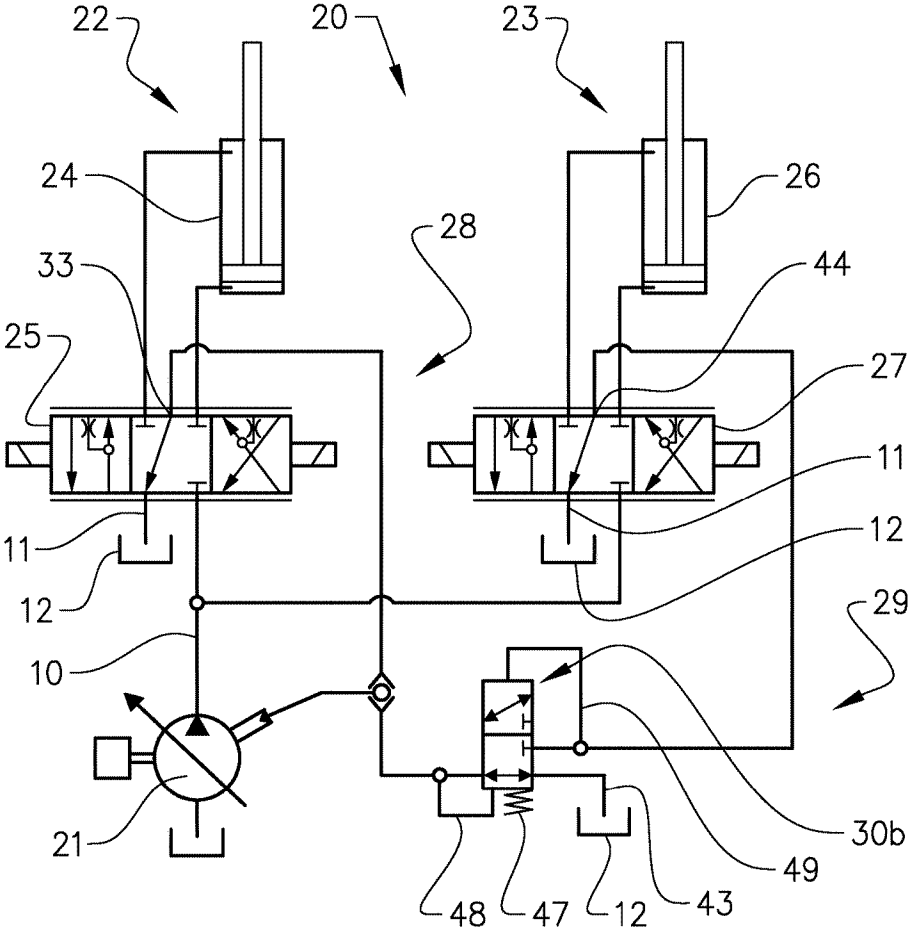
FIG. 3 shows a further embodiment of the hydraulic system according to the invention.

In FIG. 3 and FIG. 3*b* an example embodiment with a negative offset valve 30*b* is illustrated. For the features of the hydraulic system already described in connection with the example embodiment illustrated in FIG. 2, reference is made to FIG. 2. Only features and functions unique for the example embodiment illustrated in FIGS. 3 and 3*b* will be described in detail. Same reference numerals used in FIGS. 3 and 3*b* as in FIG. 2 will indicate same or similar components as already described with reference to FIGS. 2 and 2*a*, and hereinafter some of these components will only be briefly described or not described at all.

The offset valve 30*b* in FIG. 3*b* comprises a first port 41 for connection to the incoming LS pressure and a second port 42 for connection to a pressure source having lower pressure than the incoming LS pressure. This pressure has to be lower than the incoming LS pressure minus the desired change in LS pressure ΔP, or a lower pressure.

The pressure source can be the tank 12 and in this example the tank pressure 12 is applied to the first port by means of a conduit 43. The incoming LS pressure can be received from an LS port 44 of the second control valve 27 by means of the second LS circuit 29.

The offset valve 30*b* further comprises a port 45 for providing a decreased LS pressure, and a spool 46 for selecting between a first state, where the first port 41 is closed and the second port 42 is opened, and a second state, where the first port 41 is opened and the second port 42 is closed. Furthermore, the offset valve 30*b* comprises a spring 47 arranged to apply a force on the spool 46 in a first direction towards the first state, and the hydraulic system has a means 48 for applying the decreased LS pressure to the spool 46 for creating a force in the first direction towards the first state, and a means 49 for applying the incoming LS pressure to the spool 46 for creating a force in a second direction towards the second state.

The means for applying the incoming LS pressure to the spool 46 can be a conduit 49 connecting the second LS pressure circuit 29 and the spool 46 of the valve and the means for applying the decreased LS pressure to the spool 46 of the valve can be a conduit 48 connecting the decreased LS pressure port 45 of the valve and the spool 46 of the valve.

By selecting a spring 47 giving a certain spring force, the desired offset can be reached. The decreased LS pressure provided to the pump is $P_{LS}-\Delta P$. Where ΔP is a function of the spring force caused by the spring 47.

For the system illustrated in FIG. 3, the margin pressure of the pump can for example be set to 23 bar. The offset valve can be adapted to decrease the LS pressure such that the effective margin pressure will be for example 10 bar. The pump 21 will then supply hydraulic fluid to the first actuator 24 with a pressure drop over the first control valve 25 of 23 bar and to the second actuator 26 with a pressure drop over the second control valve 27 of 10 bar.

Figure 4:
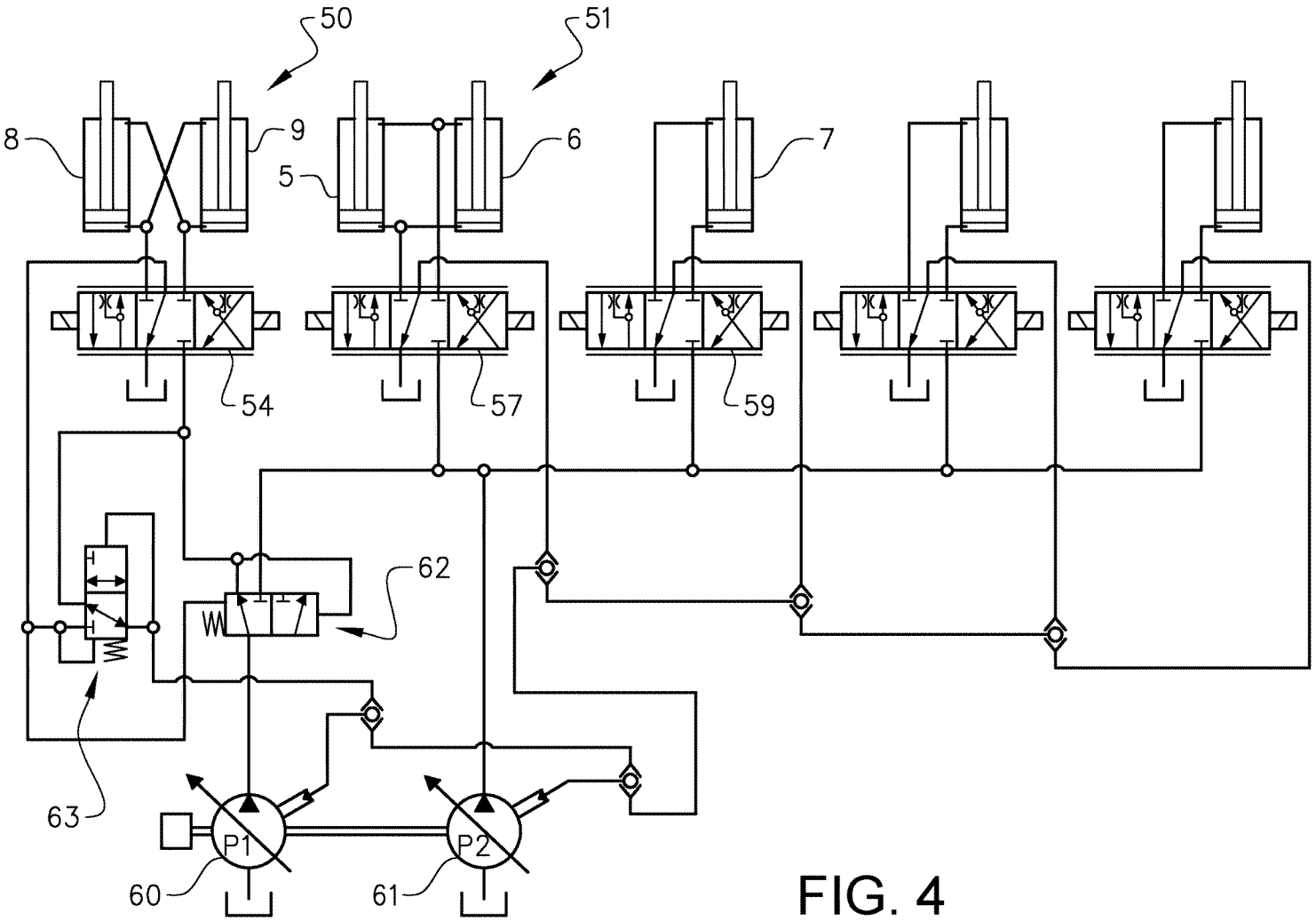
FIG. 4 is a further embodiment of the hydraulic system according to the invention.

In FIG. 4 a further example embodiment of the hydraulic system for a wheel loader is illustrated. The hydraulic system comprises one function 50 arranged for steering and another function 51 for working hydraulics. The steering function comprises two hydraulic cylinders 8, 9 and a control valve 54. See also FIG. 1. The working hydraulics in turn comprises two hydraulic cylinders 5, 6 and a control valve 57 for a lift function, and one hydraulic cylinder 7 and a control valve 59 for a tilt function. In addition, further functions for auxiliary equipment can be added. Such an auxiliary function could comprise a hydraulic cylinder and a control valve. All hydraulic cylinders are supplied by two pumps 60, 61. The use of the pumps for either the steering or the working hydraulics, or both, is determined by a prioritizing valve 62 which prioritizes the steering function over the working hydraulics in a conventional manner.

Since the steering function requires a higher margin pressure than the working hydraulics, a positive offset valve 63 is arranged for increasing the margin pressure of the steering function and thereby the pressure drop over corresponding control valve 54.

It is to be understood that the present invention is not limited to the embodiments described above and illustrated in the drawings; rather, the skilled person will recognize that many changes and modifications may be made within the scope of the appended claims. For example, of course the hydraulic system could comprise two or more actuators, such as hydraulic cylinders or any other type of hydraulic actuators or equipment, and LS pressures representing two or more functions can be changed (positive or negative offset) by the use of an offset valve for each function.

The invention claimed is:

1. A hydraulic system for a working machine, the hydraulic system being a load sensing (LS) system and comprising a first hydraulic actuator and a first control valve for controlling the flow of hydraulic fluid from a pump, to the first hydraulic actuator and for draining hydraulic fluid from the first hydraulic actuator, respectively, a second hydraulic actuator and a second control valve for controlling the flow of hydraulic fluid from the pump to the second hydraulic actuator and for draining hydraulic fluid from the second hydraulic actuator, respectively, a first hydraulic circuit for providing an LS pressure for the first actuator and a second hydraulic circuit for providing an LS pressure for the second actuator, wherein at least one of the first and second circuits comprises an offset valve for increasing the LS pressure before providing the LS pressure to the pump, wherein the offset valve comprises a first port for connection to the incoming LS pressure and a second port for connection to a pressure source having higher pressure than the incoming LS pressure, and a port for providing an increased LS pressure, a spool for selecting between a first state, where the first port is closed and the second port is opened, and a second state, where the first port is opened and the second port is closed, and a spring arranged to apply a force on the spool in a first direction to yards the first state, a conduit connecting the first hydraulic circuit and the spool for applying the incoming LS pressure to the spool for creating, a force in the first direction towards the first state, and a conduit connecting the port and the spool for applying the increased LS pressure to the spool for creating a force in a second direction towards the second state.

2. A hydraulic system according to claim 1, wherein the second port is connected to the pump pressure.

3. A hydraulic system according to claim 1, wherein the first and second hydraulic circuits for providing LS pressures are connected to a shuttle valve where the highest LS pressure is provided for controlling the pump.

4. A working machine comprising a hydraulic system according to claim 1.

5. A hydraulic system for a working machine, the hydraulic system being a load sensing (LS) system and comprising a first hydraulic actuator and a first control valve for controlling the flow of hydraulic fluid from a pump to the first hydraulic actuator and for draining hydraulic fluid from the first hydraulic actuator, respectively, a second hydraulic actuator and a second control valve for controlling the flow of hydraulic fluid from the pump to the second hydraulic actuator and for draining hydraulic fluid from the second hydraulic actuator, respectively, the hydraulic system further comprising a first hydraulic circuit for providing an LS pressure for the first actuator and a second hydraulic circuit for providing an LS pressure for the second actuator, wherein at least one of the first and second circuits comprises an offset valve for decreasing the LS pressure before providing the LS pressure to the pump, wherein the offset valve comprises a first port for connection to the incoming LS pressure and a second port for connection to a pressure source having lower pressure than the incoming LS pressure, a port for providing an decreased LS pressure, and a spool for selecting between a fast state, where the first port is closed and the second port is opened, and a second state, where the first port is opened and the second port is closed, a spring arranged to apply a force on the spool in a first direction towards the first state, and a conduit connecting the port and the spool for applying the decreased LS pressure to the spool for creating a force in the first direction towards the first state, and a conduit connecting the second hydraulic circuit and the spool for applying the incoming LS pressure to the spool for creating a force in a second direction towards the second state.

6. A hydraulic system according to claim 5, wherein the first port is connected to tank.

7. A hydraulic system according to claim 5, wherein the first and second hydraulic circuits for providing LS pressures are connected to a shuttle valve where the highest LS pressure is provided for controlling the pump.

8. A working machine comprising a hydraulic system according to claim 5.

* * * * *